United States Patent [19]

House

[11] 4,435,119

[45] Mar. 6, 1984

[54] LIFT TRUCK LOAD CLAMP HAVING POWER-ACTUATED PIVOTAL SUBFRAME FOR HANDLING PAPER ROLLS

[75] Inventor: Marshall K. House, Portland, Oreg.

[73] Assignee: Cascade Corporation, Portland, Oreg.

[21] Appl. No.: 321,921

[22] Filed: Nov. 16, 1981

[51] Int. Cl.[3] ..... B66F 9/18

[52] U.S. Cl. ..... 414/620; 294/88; 294/106; 414/621; 414/642; 414/911

[58] Field of Search ..... 414/619, 620, 621, 622, 414/623, 642, 672, 911; 294/86 R, 88, 106

[56] References Cited

U.S. PATENT DOCUMENTS

| | | | |
|---|---|---|---|
| 2,815,878 | 12/1957 | Vance | 414/620 |
| 2,916,171 | 12/1959 | Schwarz | 414/621 |
| 3,139,302 | 6/1964 | Orloff et al. | 294/88 |
| 3,342,359 | 9/1967 | Sawdey | 414/620 |
| 3,363,929 | 1/1968 | Nelson | 294/88 |
| 3,407,951 | 10/1968 | Faust et al. | 414/621 |
| 3,896,957 | 7/1975 | Sinclair | 414/620 |
| 3,982,782 | 9/1976 | Bos | 414/623 X |
| 4,127,205 | 11/1978 | Farmer et al. | 414/620 |
| 4,209,280 | 6/1980 | Bittner | 414/911 X |
| 4,217,074 | 8/1980 | Leasor et al. | 414/642 |

OTHER PUBLICATIONS

2-A Roll Clamp Assembly, Wilby Manufacturing, Ltd., Canada, Dec. 7, 1977.

*Primary Examiner*—Leslie J. Paperner

*Attorney, Agent, or Firm*—Chernoff, Vilhauer, McClung, Birdwell & Stenzel

[57] ABSTRACT

A lift truck rotatable paper roll handling clamp of the pivoted arm type for clamping paper rolls of varying diameters and shifting the position of the roll relative to the lift truck between a position of unequal extension, wherein the forward end of one clamp arm extends a greater distance forwardly than the forward end of the other clamp arm, and a position of equal extension wherein the forward ends of the clamp arms extend a substantially equal distance forwardly of the lift truck. The clamp has a rotatable frame upon which a subframe is mounted by a first pivotal connection for selective tilting of the subframe relative to the rotatable frame. Mounted upon the subframe are a pair of clamp arms, each being pivotally connected to the subframe at spaced pivotal connections located on either side of the first pivotal connection. One clamp arm is longer than the other, and pivots with respect to the subframe through a greater maximum angle than does the other arm. The respective hydraulic power actuators for pivoting the subframe relative to the rotatable frame and for pivoting each clamp arm relative to the subframe are in a compact arrangement all intersecting a common plane perpendicular to the axis of rotation of the rotator to minimize the forward protrusion of the paper rolls and thereby maximize the weight-carrying capacity of the lift truck.

17 Claims, 4 Drawing Figures

LIFT TRUCK LOAD CLAMP HAVING POWER-ACTUATED PIVOTAL SUBFRAME FOR HANDLING PAPER ROLLS

Background of the Invention

The present invention relates to improvements in lift truck mounted, pivoted arm clamping apparatus for picking up, transporting and stacking large rolls of paper such as newsprint and kraft paper.

In the past a number of pivoted arm, lift truck-mounted paper roll clamps have been developed wherein the clamp arms are capable of engaging a given paper roll both in a position of unequal extension, wherein the forward end of one clamp arm extends a greater distance forwardly of the lift truck than the forward end of the other clamp arm and, alternatively, in a position of equal extension wherein the forward ends of the clamp arms on either side of the paper roll extend a substantially equal distance forwardly of the lift truck. The unequal extension position is needed when a paper roll is lying in a horizontal orientation on the floor or other supporting surface, such that the upper clamp arm can overreach the lower clamp arm in order to assume substantially diametrically opposed positions for grasping the roll firmly to pick it up. Thereafter, if the paper roll is to be stacked vertically by rotating the clamp about its axis of rotation, it is desirable that both clamp arms extend substantially the same distance from the truck to facilitate placing the vertical paper roll in close, compact proximity to other vertical paper rolls as well as to extract a vertically-oriented roll from a compact array of vertical rolls. The equal arm extension position facilitates such handling of vertically-oriented rolls by facilitating the insertion of both clamp arms simultaneously between closely adjacent vertical rolls without damaging them.

Prior pivoted arm paper roll clamps capable of accomplishing these objectives include a single-pivot clamp structure shown in Sinclair U.S. Pat. No. 3,896,957, a dual-pivot clamp structure shown in Farmer et al U.S. Pat. No. 4,127,205 and another dual-pivot clamp structure manufactured by Wilby Manufacturing Ltd. of Canada.

The dual-pivot structure of U.S. Pat. No. 4,127,205 advantageously centers the paper roll at or near the axis of rotation of the clamp when the clamp arms are in the equal extension position, and decenters the roll transversely to the rotational axis of the clamp in the unequal extension position. However, in moving from the unequal extension position to the position of equal extension, this clamp tends to move the center of gravity of the roll forwardly with respect to the lift truck by a distance which, if the roll is of a weight which is at or near the load-handling capacity of a counterbalanced lift truck, could lead to forward instability of the lift truck, thereby possibly requiring a larger lift truck to handle a paper roll of a given size. The Sinclair single-pivot clamp and the Wilby dual-pivot clamp, on the other hand, cause lesser forward movement of the center of gravity of the roll during shifting from the unequal to the equal arm position but cannot advantageously center the roll at or near the clamp's rotational axis in the equal extension position. Moreover, none of these clamps is capable of centering, on or near the clamp axis of rotation, rolls of relatively small diameter. This makes it difficult to stack or retrieve such a small roll in a vertical orientation in the presence of other closely-adjacent vertically-oriented rolls.

Some clamps having more elaborate types of pivot arrangements have been developed for general load-manipulating purposes, but they are not suitable for paper roll handling. Nelson U.S. Pat. No. 3,363,929 shows a lift truck mounted three-pivot clamp having an elongate, articulated boom for grasping hard-to-reach, obviously lightweight objects. Orloff et al U.S. Pat. No. 3,139,302 shows a suspended four-pivot clamp for manipulating loads of various shapes. Such clamps are incapable of adaptation to the special problems of paper roll handling for several reasons. For example, their structures would require the center of gravity of the paper roll to be located far forwardly of the front of any counterbalanced lift truck upon which they might be mounted, thereby rendering unstable any such lift truck except one whose load-carrying capacity is far in excess of the weight of the paper roll and whose size and lack of maneuverability are therefore unacceptable. As a further example, because such clamps employ a pair of clamp arms of equal length, diametrically opposed engagement of a horizontally-oriented paper roll lying on the floor or other supporting surface would be difficult. Alternatively, trying to remedy this deficiency by making the arms of unequal length would make it impossible for the clamps to achieve a substantially centered equal arm extension position.

Accordingly, what is needed is an improvement in pivoted arm paper roll clamps for lift trucks which renders compatible at least most, and preferably all, of the following heretofore incompatible objectives:

(1) substantially centered equal arm extension position for large-diameter rolls relative to the clamp rotational axis;

(2) significantly decentered unequal arm extension position capable of diametrically-opposed grasping of horizontally-oriented rolls on the floor or other supporting surface;

(3) minimized forward movement of the roll's center of gravity as the clamp shifts from the unequal to the equal arm extension position;

(4) substantial centering of rolls of relatively small diameters; and (5) compact arrangement of the clamp's actuation mechanisms so as to maintain the roll's center of gravity as close as possible to the front of the lift truck.

Summary of the Present Invention

The present invention is directed to a pivoted arm clamp which renders compatible at least most, and preferably all, of the foregoing objectives. The clamp of the present invention employs a subframe pivotally mounted upon the rotatable frame of the clamp by a pivotal connection located at or closely adjacent to the rotational axis of the rotator with a hydraulic power actuator selectively controlling the pivoting of the subframe. On each side of such pivotal connection a respective clamp arm is pivotally connected to the subframe, each clamp arm being actuated by a respective hydraulic power actuator interconnecting the respective clamp arm with the subframe. Each clamp arm actuator pivots its respective clamp arm angularly with respect to the subframe to open and close the clamp arms selectively relative to each other. The subframe actuator in turn selectively pivots the subframe angularly with respect to the rotating frame, thereby angularly shifting the clamp arms as a single unit relative to the rotating frame.

One of the clamp arms is longer than the other and is pivoted by its hydraulic actuator relative to the subframe through a maximum angle greater than that through which the shorter clamp arm pivots with respect to the subframe. This feature ensures significantly decentered diametric gripping of paper rolls lying horizontally on the floor or other supporting surface with the clamp arms in the position of unequal extension.

During closure of the clamp arms, their pivoting is coordinated so that they move in unison at different angular speeds proportional to each other, the angular speed of the longer clamp arm being the greater. This, together with the subframe pivoting arrangement, enable shifting of the clamp arms, when handling relatively large paper rolls of different diameters, to a position of equal extension with the center of gravity of the roll substantially centered on the rotational axis of the clamp's rotator by pivoting of the subframe relative to the rotatable frame. Such pivoting action also minimizes the forward movement of the roll's center of gravity due to the fact that the two pivotal connections of the clamp arms to the subframe are positioned on either side of the subframe's pivotal connection to the rotatable frame.

The fact that both clamp arms, rather than merely one of them, are pivotable with respect to the subframe permits even small diameter rolls to be shifted to a relatively central position to facilitate their handling when they are rotated to a vertical orientation.

The foregoing advantageous functions are accomplished without any additional forward space being required for the subframe and the various hydraulic actuators which control the pivoting movement of the respective clamp arms and the subframe, which would otherwise negate the gains in roll weight capacity achieved by reducing forward movement of the roll's center of gravity during shifting of the clamp arms from unequal to equal arm extension. The various hydraulic power actuators are arranged in a compact fashion whereby they intersect a common plane extending perpendicular to the clamp's axis of rotation. This is made possible in part by the fact that the subframe actuator is connected to the subframe at a location at least as far forwardly, and preferably more forwardly, than the location of the pivotal connection between the subframe and the rotatable frame.

Because the shorter clamp arm is pivotable with respect to the subframe through a substantial angular distance such that the end of the subframe protrudes transversely beyond the shorter arm when it is pivoted inwardly to its maximum range of travel, rollers are provided on the protruding end of the subframe in anticipation of the possibility that the subframe might inadvertently strike the floor or other supporting surface when the lift truck carriage is depressed to engage a small-diameter horizontally-oriented roll. This ensures smoothness of operation and prevents damage to the clamp assembly.

Accordingly, it is a primary objective of the present invention to render compatible, in a single pivoted arm clamp structure, most and preferably all of the five operational objectives set forth previously.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
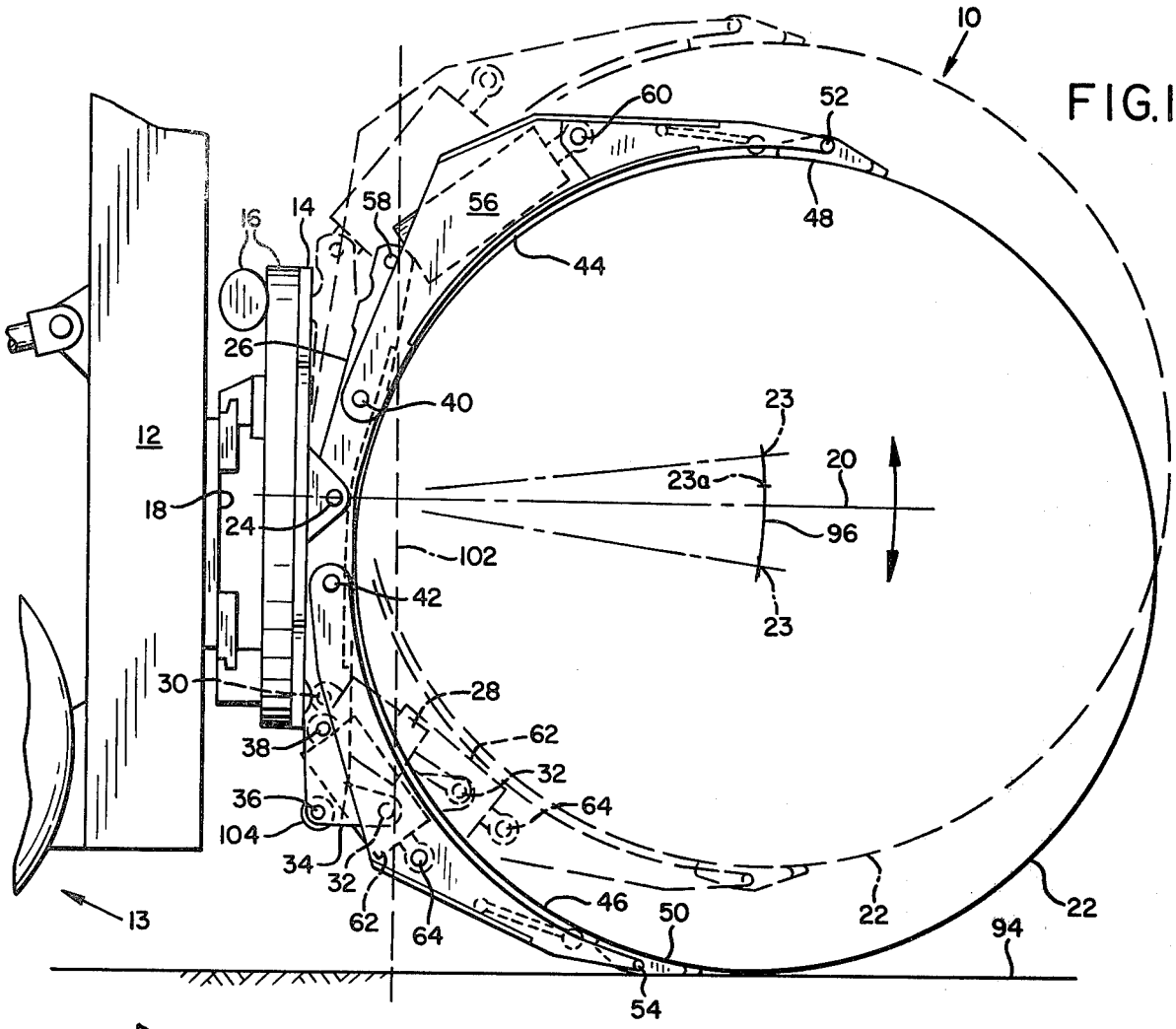
FIG. 1 is a side view of an exemplary embodiment of the paper roll clamp of the present invention, with the clamp arms shown approximately at their maximum open positions for handling a horizontal paper roll of large diameter and depicting the maximum range of shifting movement of the arms as provided by the subframe.

With reference to FIG. 1, the paper roll handling clamp designated generally as 10 is mounted on a mast 12 at the forward end of a counterbalanced lift truck 13. The clamp 10 has a frame 14 which is rotatably mounted by means of a rotator 16 upon a carriage 18 which moves vertically selectively upward or downward on the mast 12. The rotator 16 provides powered rotation of the rotatable frame 14 about an axis of rotation 20 extending generally forwardly from the mast 12 and carriage 18 along the longitudinal centerline of the lift truck. Such rotation permits the clamp 10 to handle paper rolls such as 22 both in a horizontal orientation as shown in FIG. 1 or, alternatively, in a vertical orientation.

Figure 2:
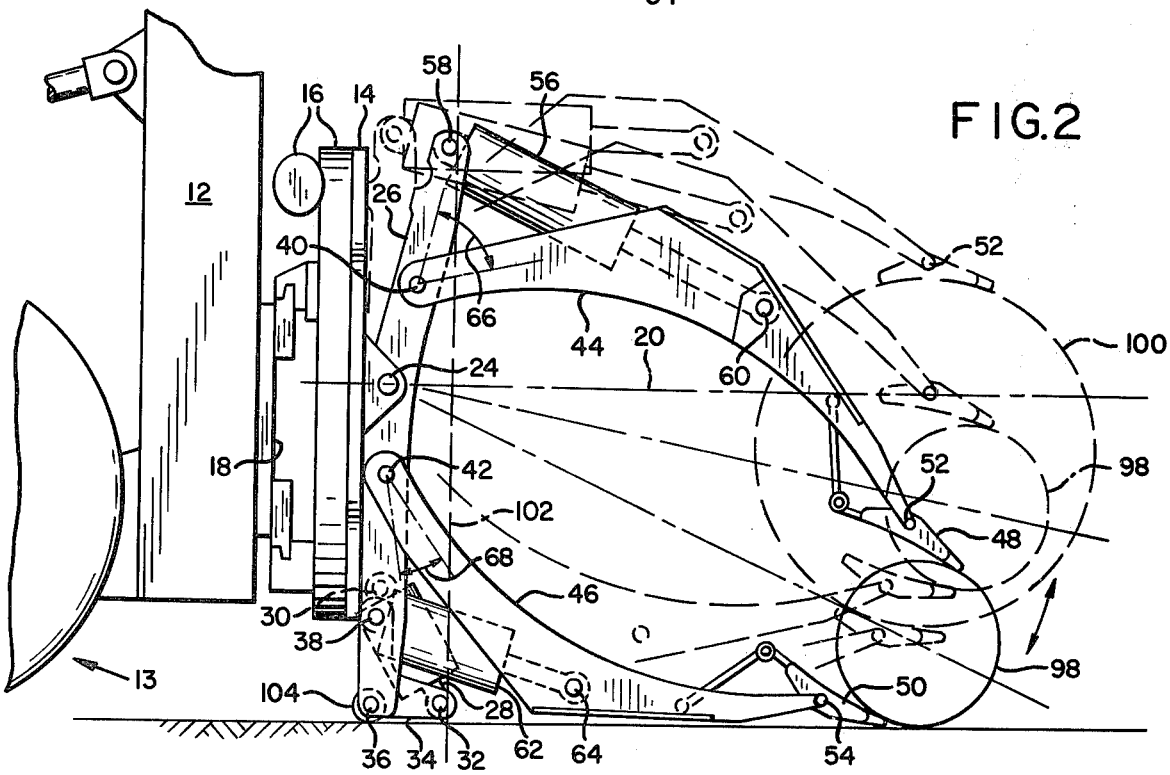
FIG. 2 is a side view of the clamp of FIG. 1 with the clamp arms shown at minimum and intermediate open positions for handling small paper rolls.
Figure 3:
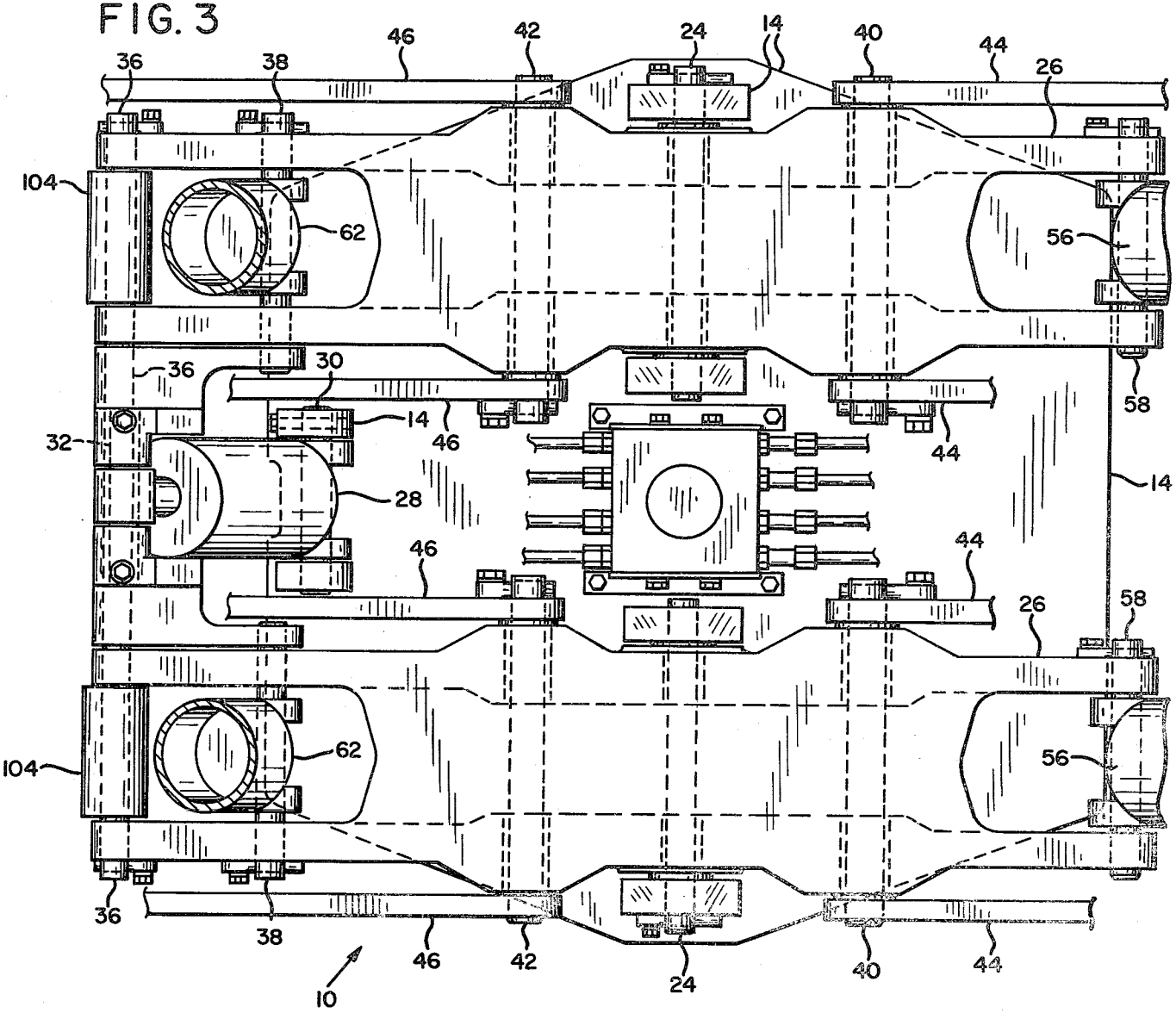
FIG. 3 is a partial front view of the clamp of FIG. 1, with portions removed to reveal underlying structure and with the clamp arms rotated to a position for handling of vertically-oriented rolls.

Pivotally mounted upon the rotatable frame 14 by means of a pair of axially-aligned pins 24, only one of which is shown in FIGS. 1 and 2 but both of which are shown in FIG. 3, is a subframe 26. Pins 24 permit the subframe 26 to pivot with respect to the rotatable frame 14 about a pivot axis extending transverse to the axis of rotation 20 in response to the selective extension or retraction of a double-acting hydraulic ram assembly 28. The ram assembly 28 is pivotally connected at its base by a pin 30 to the rotatable frame 14 and pivotally connected at its opposite end to the subframe 26 by a pin 32 mounted in a lever-shaped nember 34 which is rigidly connected by pins 36 and 38 respectively to the subframe 26 so as to constitute a rigid part thereof. It will be noted that the pin 32 which connects the ram assembly 28 to the subframe 26 is positioned forwardly of the pins 24 by which the subframe 26 pivots with respect to the rotatable frame 14. This permits the inclusion of the ram assembly 28 operationally between the rotatable frame 14 and the subframe 26 without requiring the subframe 26 to be moved forwardly with respect to the rotatable frame 14, which would otherwise move the center of gravity of the paper roll 22 forwardly and thereby reduce the load-carrying capacity of the counterbalanced lift truck 13.

It will be appreciated that if the axis of the pin 32 were not positioned at least as far forwardly as the axis of the aligned pins 24, the subframe 26 would have to be positioned substantially forwardly of its location as shown in the figures, which would detract seriously from the load-carrying capacity of the lift truck 13. Alternatively, the ram assembly 28 would have to protrude rearwardly into the area of the rotator 16 causing serious design problems.

The subframe 26 includes two portions extending transversely in each direction from the pivot pins 24, each portion mounting respective pairs of transversely-extending, axially-aligned pivot pins 40 and 42 respectively. Pivotally mounted upon the subframe 26 by pivot pins 40 is a forwardly-projecting, selectively openable and closeable clamp arm 44, while a shorter clamp arm 46 is pivotally mounted on the subframe 26 by means of pins 42. Each clamp arm is equipped with a respective paper roll engaging arcuate contact pad 48, 50 at the forward end of the respective clamp arm 44, 46. Each contact pad is hingedly connected to the remainder of the clamp arm by a respective hinge 52, 54.

Clamp arm 44 is pivotable angularly with respect to the subframe 26 selectively toward and away from the shorter clamp arm 46 by the selective extension and retraction of a pair of double-acting hydraulic ram assemblies 56 pivotally connected to the subframe 26 at their bases by respective pins 58, and at their forward ends to the clamp arm 44 by respective pins 60. Likewise, clamp arm 46 is selectively pivotable angularly with respect to subframe 26 toward and away from the longer clamp arm 44 by hydraulic ram assemblies 62 pivotally connected at their bases to the subframe 26 by pins 38 and at their forward ends to the clamp arm 46 by pins 64.

As best seen in FIG. 2, it will be noted that ram assemblies 56 have greater extensibility than do ram assemblies 62, which permits a substantially greater range of angular movement of the longer arm 44 with respect to the subframe 26, as depicted by the angle 66 in FIG. 2, than the corresponding range of angular movement of the shorter arm 46 as depicted by the angle 68 in FIG. 2. Preferably the range of angular movement of the longer arm 44 is approximately twice that of the shorter arm 46.

Figure 4:
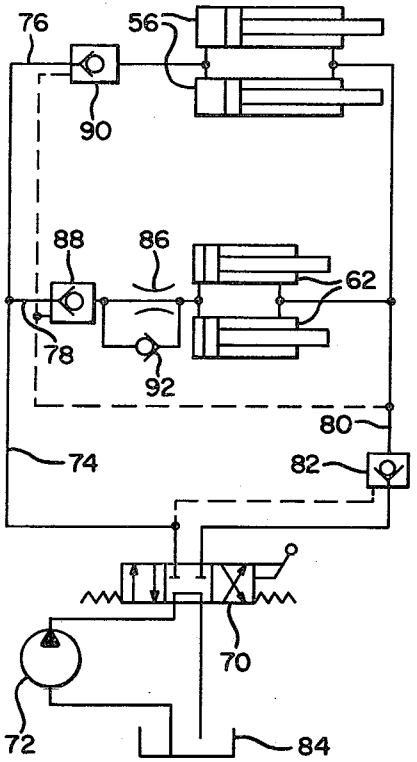
FIG. 4 is a simplified hydraulic circuit diagram showing the manner in which the respective clamp arm hydraulic actuators are coordinated to cause angular movement of the clamp arms toward each other in unison at different angular speeds.

With reference to FIG. 4, the respective hydraulic ram assemblies 56 and 62 are coordinated hydraulically such that they pivot the clamp arms 44 and 46 in unison toward each other during closure at different angular speeds proportional to each other, the angular speed of the longer arm 44 preferably being approximately twice that of the shorter arm 46. To close the clamp arms, the lift truck operator moves the spool of valve 70 to the right as shown in FIG. 4, thereby directing pressurized fluid from the hydraulic pump 72 through conduit 74 and conduits 76 and 78 simultaneously to the bases of ram assemblies 56 and 62 while fluid is simultaneously exhausted from the forward end of the ram assemblies through conduit 80 and pilot-operated check valve 82 to the hydraulic reservoir 84. It will be noted that a restriction 86 is interposed between conduit 78 and the bases of ram assemblies 62 which actuate the shorter clamp arm 46, whereas no such restriction is interposed between conduit 76 and the bases of ram assemblies 56. Restriction 86 is sized so as to decrease the volumetric flow rate of hydraulic fluid to ram assemblies 62 from that flowing to ram assemblies 56 by a predetermined amount, the decrease being such as to cause the desired lesser angular rate of pivoting motion of clamp arm 46. Conversely, to open the clamp arms the operator moves the spool of the valve 70 to the left in FIG. 4 thereby introducing fluid to the forward ends of ram assemblies 56 and 62 through conduit 80 while fluid from the bases of the ram assemblies is simultaneously exhausted through pilot-operated check valves 88 and 90 through conduits 76, 78 and 74 respectively. During opening of the clamp arms, fluid from the bases of ram assemblies 62 need not be exhausted through the restriction 86 but rather may be exhausted through a parallel check valve 92, thereby permitting greater angular speed of the clamp arm 46 during opening than during closing thereof.

As an alternative to the above-described hydraulic arrangement for coordinating the closure of the clamp arms in unison, other arrangements within the scope of the invention might include one or more hydraulic actuators pivoting one of the clamp arms, the other arm being pivoted in unison by a mechanical linkage or lever arrangement interconnecting the two clamp arms.

The operational results of the foregoing structure can be observed with respect to FIGS. 1 and 2. In FIG. 1, clamp arms 44 and 46 are shown at approximately their maximum open position for handling large-diameter paper roll 22. In the downwardly-pivoted position of the subframe 26 shown in solid lines in FIG. 1 the clamp arms are in a position of unequal extension for engaging the horizontal roll 22, resting on the floor 94, in substantially diametrically-opposed positions for firmly grasping the roll. In this condition the center of gravity 23 of the roll is substantially offset or decentered from the axis of rotation 20 of the rotator 16.

Extension of ram assembly 28 to pivot subframe 26 upwardly results in movement of the center of gravity 23 of the roll 22 through an arcuate path 96 to an opposite position of unequal extension of the arms 44 and 46 as shown in phantom in FIG. 1. In between these two extremes, the clamp arms 44 and 46 will reach a position of equal extension at which the center of gravity 23 of the roll 22 will be approximately centered on the rotational axis 20 of the rotator 16, i.e. approximately at the position indicated as 23*a*. With the arms in such equal extension position, the rotator 16 would normally be actuated to rotate the arms 90° so that the roll is vertical. In the substantially centered condition of the roll in the equal arm extension position, insertion of the roll between other closely adjacent vertically-oriented rolls is facilitated by the ease of insertion of the clamp arms 44 and 46 between adjacent rolls in such position. Likewise, extraction of a vertically-oriented roll from between other rolls is facilitated for the same reasons.

It will be noted that, in shifting the roll 22 from the position of unequal arm extension shown in solid lines in FIG. 1 to the position of equal arm extension, the shallow arcuate path 96 of the roll's center of gravity 23 causes no more than an insignificant amount of forward movement of the center of gravity 23 relative to the lift truck. Accordingly such slight forward movement is unlikely to cause forward instability of the counterbalanced lift truck 13.

In FIG. 2 the characteristics of the clamp when handling rolls such as 98 or 100, of very small diameter compared to the larger roll 22, are depicted. The minimum open position of the clamp arms 44 and 46 with the subframe 26 pivoted fully downward are represented in solid lines. It will be noted that, even with an extremely small diameter roll 98, the ability not only of the longer arm 44 but also of the shorter arm 46 to pivot with respect to the subframe 26 enables the placement of such small roll 98 in a position, shown in phantom, not far removed from the rotational axis 20 of the clamp by upward tilting of the subframe 26. With only a slightly larger, but still exceptionally small diameter, roll 100 it will be seen that this same feature permits roll 100 to be nearly centered on the rotational axis 20 with the clamp arms in a position quite nearly approaching that of equal extension. Thus the clamp very advantageously facilitates the handling of not only large, but also exceptionally small, vertically-oriented rolls in connection with their insertion and retrieval relative to other closely-adjacent vertical rolls.

In order to achieve the foregoing advantageous functions without any additional forward space being required for the subframe and the various hydraulic ram assemblies, the hydraulic ram assemblies are arranged in a compact fashion wherein at least ram assemblies 28 and 62 on the same side of the pivot 24 intersect a common plane extending perpendicular to the clamp's axis of rotation 20, such as the plane whose edge is depicted by the phantom line 102 in FIGS. 1 and 2. Preferably, for maximum compactness, all of the hydraulic ram assemblies 28, 56 and 62 intersect such plane as depicted in the figures. It will be appreciated that without at least the subframe ram assembly 28 and the short arm ram assembly 62 intersecting such a common plane, the gain in roll weight capacity achieved by reducing forward movement of the roll's center of gravity during shifting of the clamp arms from unequal to equal arm extension would be negated.

Because the shorter clamp arm 46 is pivotable inwardly with respect to the subframe 26 such that the lower end of the subframe as shown in FIG. 2 protrudes transversely beyond the arm 46 when such arm is at its maximum inward range of travel as shown in FIG. 2, a pair of rollers 104 are rotatably mounted on pin 36 at such end of the subframe for abutting the floor or other supporting surface without detriment to the clamp or its operation if the lift truck carriage is inadvertently depressed excessively to engage a small-diameter horizontally-oriented roll such as 98. Each roller 104 protrudes transversely beyond the end of the subframe 26 sufficiently that the roller, rather than the end of the subframe, will abut the supporting surface under such circumstances without interfering with the forward motion of the lift truck 13 as it inserts the clamp arm 46 beneath a horizontally-oriented roll and without otherwise damaging the clamp 10.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and first pivotal connection means connecting said subframe to said frame for permitting said subframe to pivot with respect to said frame about a first pivot axis extending transverse to said forwardly-extending axis of rotation;

(d) first and second selectively openable and closeable opposing clamp arms mounted upon said subframe projecting therefrom in a forward direction, each of said pair of clamp arms having a forward end;

(e) second pivotal connection means connecting said first clamp arm to said subframe for permitting said first clamp arm to pivot with respect to said subframe about a second pivot axis transverse to said forwardly-extending axis of rotation, and third pivotal connection means connecting said second clamp arm to said subframe for permitting said second clamp arm to pivot with respect to said subframe about a third pivot axis extending transverse to said forwardly-extending axis of rotation;

(f) said second and third pivot axes being spaced apart in a direction transverse to said forwardly-extending axis of rotation and said first pivot axis being located between said second and third pivot axes;

(g) subframe power means interconnecting said frame and said subframe for selectively pivoting said subframe with respect to said frame about said first pivot axis;

(h) clamp arm power means connecting said first and second clamp arms respectively with said subframe for selectively pivoting said first and second clamp arms through respective maximum angles relative to said subframe;

(i) said clamp arm power means including means for pivoting said first clamp arm through a greater maximum angle relative to said subframe than the maximum angle through which said second clamp arm pivots relative to said subframe.

2. The load-handling clamp of claim 1 wherein said clamp arm power means includes means for pivoting said first and second clamp arms respectively toward each other in unison while pivoting said first clamp arm at a greater angular speed relative to said subframe than said second lamp arm.

3. The load-handling clamp of claim 1 or 2 wherein the distance between said second pivot axis and the forward end of said first clamp arm is greater than the distance between said third pivot axis and the forward end of said second clamp arm.

4. The load-handling clamp of claim 3 wherein said subframe power means includes means for selectively pivoting said subframe with respect to said frame to a position wherein the forward ends of said first and second clamp arms extend a substantially equal distance forwardly of said frame.

5. The load-handling clamp of claim 1 or 2 wherein said subframe power means and said clamp arm power means intersect a common plane perpendicular to said forwardly-extending axis of rotation.

6. The load-handling clamp of claim 5 wherein said clamp arm power means includes first power means interconnecting said first clamp arm with said subframe and second power means interconnecting said second clamp arm with said subframe, said first, second and subframe power means respectively all intersecting a common plane perpendicular to said forwardly-extending axis of rotation.

7. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and first pivotal connection means connecting said subframe to said frame for permitting said subframe to pivot with respect to said frame about a first pivot axis extending transverse to said forwardly-extending axis of rotation;

(d) first and second selectively openable and closeable opposing clamp arms mounted upon said subframe projecting therefrom in a forward direction, each of said pair of clamp arms having a forward end;

(e) second pivotal connection means connecting said first clamp arm to said subframe for permitting said first clamp arm to pivot with respect to said subframe about a second pivot axis transverse to said forwardly-extending axis of rotation, and third pivotal connection means connecting said second clamp arm to said subframe for permitting said second clamp arm to pivot with respect to said subframe about a third pivot axis extending transverse to said forwardly-extending axis of rotation;

(f) said second and third pivot axes being spaced apart in a direction transverse to said forwardly extending axis of rotation and said first pivot axis being located between said second and third pivot axes;

(g) subframe power means interconnecting said frame and said subframe for selectively pivoting said subframe with respect to said frame about said first pivot axis;

(h) clamp arm power means connecting said first and second clamp arms respectively with said subframe for selectively pivoting said first and second clamp arms respectively relative to said subframe about said second and third pivot axes respectively;

(i) the distance between said second pivot axis and the forward end of said first clamp arm being greater than the distance between said third pivot axis and the forward end of said second clamp arm;

(j) said subframe power means including means for selectively pivoting said subframe with respect to said frame to a position wherein the forward ends of said first and second clamp arms extend a substantially equal distance forwardly of said frame.

8. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and first pivotal connection means connecting said subframe to said frame for permitting said subframe to pivot with respect to said frame about a first pivot axis extending transverse to said forwardly-extending axis of rotation;

(d) first and second selectively openable and closeable opposing clamp arms mounted upon said subframe projecting therefrom in a forward direction;

(e) second pivotal connection means connecting said first clamp arm to said subframe for permitting said first clamp arm to pivot with respect to said subframe about a second pivot axis transverse to said forwardly-extending axis of rotation, and third pivotal connection means connecting said second clamp arm to said subframe for permitting said second clamp arm to pivot with respect to said subframe about a third pivot axis extending transverse to said forwardly-extending axis of rotation;

(f) said second and third pivot axes being spaced apart in a direction transverse to said forwardly-extending axis of rotation and said first pivot axis being located between said second and third pivot axes;

(g) subframe power means interconnecting said frame and said subframe for selectively pivoting said subframe with respect to said frame about said first pivot axis; and (h) clamp arm power means connecting said first and second clamp arms respectively with said subframe for selectively pivoting said first and second clamp arms respectively relative to said subframe about said second and third pivot axes respectively, said subframe power means and said clamp arm power means intersecting a common plane perpendicular to said forwardly-extending axis of rotation.

9. The load-handling clamp of claim 8 wherein said clamp arm power means includes first power means interconnecting said first clamp arm with said subframe and second power means interconnecting said second clamp arm with said subframe, said first, second and subframe power means respectively all intersecting a common plane perpendicular to said forwardly-extending axis of rotation.

10. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and first pivotal connection means connecting said subframe to said frame for permitting said subframe to pivot with respect to said frame about a first pivot axis extending transverse to said forwardly-extending axis of rotation;

(d) first and second selectively openable and closeable opposing clamp arms mounted upon said subframe projecting therefrom in a forward direction;

(e) second pivotal connection means connecting said first clamp arm to said subframe for permitting said first clamp arm to pivot with respect to said subframe about a second pivot axis transverse to said forwardly-extending axis of rotation, and third pivotal connection means connecting said second clamp arm to said subframe for permitting said second clamp arm to pivot with respect to said subframe about a third pivot axis extending transverse to said forwardly-extending axis of rotation;

(f) said second and third pivot axes being spaced apart in a direction transverse to said forwardly-extending axis of rotation and said first pivot axis being located between said second and third pivot axes; and (g) power means connected to said frame at a first location and connected to said subframe at a second location for selectively pivoting said subframe with respect to said frame about said first pivot axis, said second location being positioned at least as far forwardly as said first pivot axis.

11. The load-handling clamp of claim 10 wherein said second location is positioned forwardly of said first pivot axis.

12. The load-handling clamp of any one of claims 1, 2, 8, 9, 10 and 11 wherein said first pivot axis is nearer to said forwardly-extending axis of rotation than said second and third pivot axes respectively.

13. A load-handling clamp adapted to be mounted upon the lifting apparatus of the forward end of a lift truck for engaging a cylindrical roll of paper and the like, comprising:

(a) a frame adapted to be mounted upon said lifting apparatus so as to be selectively movable vertically by said lifting apparatus;

(b) a subframe and first pivot connection means connecting said subframe to said frame for permitting said subframe to pivot with respect to said frame about a first pivot axis extending transverse to said forwardly-extending axis of rotation;

(c) a clamp arm mounted upon said subframe projecting therefrom in a forward direction, and second pivotal connection means connecting said clamp arm to said subframe for permitting said clamp arm to pivot with respect to said subframe about a second pivot axis transverse to said forwardly-extending axis of rotation, said second pivot axis being spaced from said first pivot axis in a direction transverse to said forwardly-extending axis of rotation and said subframe extending from said first pivot axis in said direction beyond said second pivot axis to an end portion of said subframe;

(d) power means interconnecting said clamp arm with said subframe for selectively pivoting said clamp arm relative to said subframe to a position such that said end portion of said subframe extends in said direction beyond any portion of said clamp arm;

(e) said end portion of said subframe having roller means rotatably mounted thereon and extending in said direction beyond said end portion of said subframe for rotating about an axis transverse to said forwardly-extending axis of rotation.

14. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and pivotal connection means connecting said subframe to said frame for permitting said subframe to pivot with respect to said frame about a pivot axis extending transverse to said forwardly-extending axis of rotation;

(d) a pair of selectively openable and closable opposing clamp arms mounted upon said subframe projecting therefrom in a forward direction, each of said pair of clamp arms having a forward end, said clamp arms being spaced apart in a direction transverse to said forwardly-extending axis of rotation and said pivot axis being located transversely between said clamp arms;

(e) clamp arm power means mounted on said subframe for selectively opening and closing said clamp arms, said clamp arm power means including means for moving one of said clamp arms to a greater degree with respect to said subframe than the other of said clamp arms; and (f) subframe power means interconnecting said frame and said subframe for selectively pivoting said subframe with respect to said frame about said pivot axis for controllably extending the forward end of one of said clamp arms away from said frame while simultaneously retracting the forward end of the other of said clamp arms toward said frame.

15. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and pivotal connection means connecting said subframe to said frame for permitting said subframe to pivot with respect to said frame about a pivot axis extending transverse to said forwardly-extending axis of rotation;

(d) a pair of selectively openable and closable opposing clamp arms mounted upon said subframe projecting therefrom in a forward direction, each of said pair of clamp arms having a forward end, said clamp arms being spaced apart in a direction transverse to said forwardly-extending axis of rotation and said pivot axis being located transversely between said clamp arms, the respective distances by which the forward ends of said respective clamp arms project forwardly from said subframe being unequal; and (e) subframe power means interconnecting said frame and said subframe for selectively pivoting said subframe with respect to said frame about said pivot axis for controllably extending the forward end of one of said clamp arms away from said frame while simultaneously retracting the forward end of the other of said clamp arms toward said frame so as to move the forward ends of said clamp arms selectively between positions projecting substantially equal distances forwardly of said frame and positions projecting unequal distances forwardly of said frame, respectively.

16. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and pivotal connection means connecting said subframe to said frame for permitting said subframe to pivot with respect to said frame about a pivot axis extending transverse to said forwardly-extending axis of rotation;

(d) a pair of selectively openable and closable opposing clamp arms mounted upon said subframe projecting therefrom in a forward direction, each of said pair of clamp arms having a forward end, said clamp arms being spaced apart in a direction transverse to said forwardly-extending axis of rotation and said pivot axis being located transversely between said clamp arms;

(e) clamp arm power means mounted on said subframe for selectively opening and closing said clamp arms; and (f) subframe power means interconnecting said frame and said subframe for selectively pivoting said subframe with respect to said frame about said pivot axis for controllably extending the forward end of one of said clamp arms away from said frame while simultaneously retracting the forward end of the other of said clamp arms toward said frame, said subframe power means and said clamp arm power means intersecting a common plane perpendicular to said forwardly-extending axis of rotation.

17. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly-extending axis of rotation;

(c) a subframe and pivotal connection means connecting said subframe to said frame for permitting said subframe to pivot with respect to said frame about a pivot axis extending transverse to said forwardly-extending axis of rotation;

(d) a pair of selectively openable and closable opposing clamp arms mounted upon said subframe projecting therefrom in a forward direction, each of said pair of clamp arms having a forward end, said clamp arms being spaced apart in a direction transverse to said forwardly-extending axis of rotation and said pivot axis being located transversely between said clamp arms; and (e) subframe power means interconnecting said frame and said subframe for selectively pivoting said subframe with respect to said frame about said pivot axis for controllably extending the forward end of one of said clamp arms away from said frame while simultaneously retracting the forward end of the other of said clamp arms toward said frame, said subframe power means being connected to said frame at a first location and connected to said subframe at a second location, said second location being positioned at least as far forwardly as said pivot axis.

* * * * *

UNITED STATES PATENT AND TRADEMARK OFFICE

CERTIFICATE OF CORRECTION

PATENT NO. : 4,435,119

DATED : March 6, 1984

INVENTOR(S) : Marshall K. House

It is certified that error appears in the above-identified patent and that said Letters Patent are hereby corrected as shown below:

Col. 8, line 43 Change "lamp" to --clamp--.

Signed and Sealed this

*Twenty-second* Day of *May 1984*

[SEAL]

*Attest:*

GERALD J. MOSSINGHOFF

*Attesting Officer* *Commissioner of Patents and Trademarks*